United States Patent [19]

Keast

[11] Patent Number: 4,852,300

[45] Date of Patent: Aug. 1, 1989

[54] STACKING GATES OR DOORS

[76] Inventor: Alfred W. Keast, 1008 Juanita Ave., La Verne, Calif. 91750

[21] Appl. No.: 245,782

[22] Filed: Sep. 16, 1988

[51] Int. Cl.[4] ..... E05F 17/00

[52] U.S. Cl. ..... 49/102; 49/125

[58] Field of Search ..... 49/102, 100, 125

[56] References Cited

U.S. PATENT DOCUMENTS

| | | | |
|---|---|---|---|
| 642,098 | 1/1900 | Fassett . | |
| 700,638 | 5/1902 | Greenman . | |
| 737,308 | 8/1903 | Winslow | 49/102 |
| 1,534,210 | 4/1925 | Griffith et al. . | |
| 1,808,199 | 6/1931 | Abrams . | |
| 1,838,491 | 12/1931 | Martin . | |
| 1,852,608 | 4/1932 | Grable . | |
| 1,960,860 | 5/1934 | Allen | 49/102 X |
| 2,174,524 | 10/1939 | Nisbet . | |
| 2,178,136 | 10/1939 | Byrne . | |
| 2,373,023 | 4/1945 | Goodwin . | |
| 2,425,016 | 8/1947 | Weaver . | |
| 2,841,390 | 7/1958 | Urquhart . | |
| 3,064,723 | 11/1962 | Paillard et al. . | |
| 3,072,394 | 1/1963 | Urquhart . | |

*Primary Examiner*—Philip C. Kannan

*Attorney, Agent, or Firm*—Christie, Parker & Hale

[57] ABSTRACT

A pair of stacking gates or doors has a trailing gate and a leading gate which roll along parallel tracks between a retracted position with the gates approximately side-by-side and an extended position with the leading gate further from the retracted position than the trailing gate. Flexible roller chains are used to retract and extend the gates. A retraction chain has one end connected to an anchor fixed between the gates, is wrapped around a rear idler sprocket on the rear of the trailing gate, and is connected at the other end to the leading gate. An extension chain has one end connected to the fixed anchor, is wrapped around a front idler sprocket near the front of the trailing gate, and is connected at the other end to the rear of the leading gate. As the trailing gate is moved, the idlers move, changing the lengths of the reaches of chain and moving the leading gate twice as far as movement of the trailing gate. U-shaped brackets at the top of the gates maintain the top of the leading gate spaced apart a uniform distance from the top of the trailing gate.

15 Claims, 3 Drawing Sheets

STACKING GATES OR DOORS

BACKGROUND

This invention concerns gates or doors which, when retracted, are essentially side by side and which, when extended, are almost end to end, with a small overlap, so that a wide opening can be closed with two or three gates shorter than the width of the opening. Such gates are commonly referred to as stacking gates. Means are provided for extending and retracting such gates from one side of the opening.

It is not uncommon to close driveways with a gate that rolls to one side of the driveway along a track for opening the driveway. In some situations, to close a driveway 20 feet wide, a gate as much as 24 feet long may be used, the extra length being used to keep the gate vertical where there is no overhead guide track for the gate. In such a situation, a pocket or other location beside the driveway must be provided for the gate when it is retracted. Providing such a space for the retracted gate can sometimes be a problem. It is desirable to have gates that stack into a pocket narrower than the width of the opening that is being closed.

As openings become wider, the problems become greater. It would be desirable, for example, to have two gates substantially less than 40 feet long to close a 40-foot opening. Such stacking gates are readily provided in structures where there is overhead support since mechanisms for extending and retracting the gates can be provided overhead. This can be used in a building entrance, for example. A variety of arrangements have been provided for multiple door closures of large openings such as may be found in airplane hangers.

A problem with open-air gates on the other hand is the lack of overhead structure on which extending and retracting mechanisms can be mounted. An alternative would be to mount such an extension and retraction mechanism in a trench beneath or beside the track. This is extremely troublesome in inclement weather, particularly when there are freezing cycles. Such subterranean mechanisms are also subject to corrosion problems and maintenance difficulties.

Various extension and retraction mechanisms employing flexible cables have been devised for doors. Cables, however, have a relatively limited lifetime because of the flexing as the cables run over the various pulleys in such a system. Some gates may open and close a few hundred times per day, and the cable systems are subject to rapid deterioration and extensive maintenance requirements in such situations. It would, therefore, be desirable to employ a roller chain drive instead of a cable system, since the roller chain suffers very little from repeated flexing.

A roller chain, however, is flexible only in one dimension. It can flex around the direction of the axes of the rollers, but cannot bend to the side to any significant extent. Thus, any system employing roller chain must have the drive system in substantially a single plane. Drive systems suitable for use of cables cannot necessarily be adapted to use of roller chain, since they often do not remain in a single plane.

An arrangement sometimes used for stacking doors drives the leading door. When it has travelled a major part of its length, a dog engages the second door and drags it along. When the second door has travelled a major part of its length, a dog on the second door picks up a third door and drags it along. And so on. This closes an opening at the rate one drives the leading door. One problem with such an arrangement is that the load on the driving mechanism continually increases as additional gates are picked up. It must be designed for the load of all the gates and when pulling only one gate it may be significantly overpowered and damage something in event of a gate jamming or the like.

Thus, it is desirable that the extending and retracting forces be approximately constant throughout the travel of the gates. It may also be desirable to close the opening faster than the drive, by driving the trailing door and amplifying the motion of the trailing door to drive the leading door twice as fast.

BRIEF SUMMARY OF THE INVENTION

There is, therefore, provided in practice of this invention according a presently preferred embodiment a set of stacking gates or doors which roll along fixed parallel tracks between retracted and extended positions. In the retracted position, the gates are approximately side by side. In the extended position, the front gate is further from the retracted position than the trailing gate. There is a fixed anchor point between the tracks on which the gates roll. A flexible retraction member has one end connected to the fixed anchor, is wrapped around a rear idler on the rear of the trailing gate, and is connected at its other end to the leading gate. A flexible extension member has one end connected to the anchor, is wrapped around a front idler on the front of the trailing gate, and is connected at its other end to the rear of the leading gate. Movement of the trailing gate is transmitted to the leading gate by the retraction and extension members, causing the leading gate to move at twice the rate of the trailing gate, and twice as far as the trailing gate. Preferably the flexible members are roller chain.

BRIEF DESCRIPTION OF THE DRAWINGS

These and other features and advantages of the present invention will be better understood by reference to the following detailed description when considered in connection accompanying drawings, wherein.

DETAILED DESCRIPTION

Figure 7:
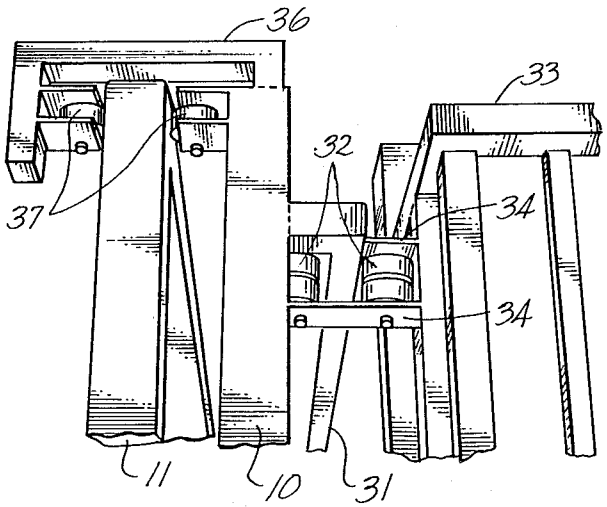
FIG. 7 is a perspective view, looking somewhat upwardly, of the front ends of a pair of gates, a support post, and a bracket for maintaining the tops of the gates apart.

Largely schematic illustrations are employed for describing this invention, which relates to the way roller chains are used for operating stacking gates, rather than the structure of the gates themselves. Some displacements have been made of the gates in the drawings, as compared with their actual positions, as an aid to exposition. Thus, structures actually built may look different from the illustrations. It will also be understood that, where the description refers to gates, they might also be called doors in some embodiments. Thus, for example, where a driveway or the like is closed, they may be called gates, and where a building entrance is closed, they might be called doors. Since the invention is particularly desirable for outdoor gates, that terminology is generally used herein.

Figure 1:
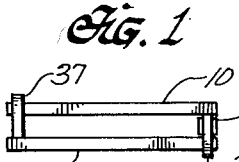
FIG. 1 is a top schematic view of a pair of retracted gates.

The two gates in the set are referred to as a trailing gate 10 and a leading gate 11. When the two gates are retracted, they are essentially side by side as illustrated in FIG. 1. In a typical embodiment, the two gates have the same length and the front end 12 of the trailing gate is substantially even with the front end 13 of the leading gate when they are in the retracted position. Similarly, the rear 14 of the trailing gate is even with the rear 15 of the leading gate. The retracted position is the position of the gates when the driveway or the like is open and the gates are "stacked" in a pocket beside the driveway.

Figure 2:
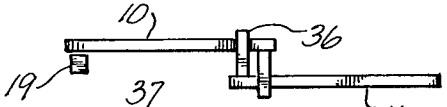
FIG. 2 is a top schematic view of the gates extended.

When the driveway is closed, the gates are in their extended position as illustrated in FIG. 2. Both gates have moved from the retracted position. The leading gate has moved twice as far as the trailing gate. The rear of the trailing gate does not move beyond the position of the front of the gates in their retracted position; that is, the trailing gate does not move all of the way out of the pocket where the gates rest when retracted. The leading gate does not move quite the full length of the trailing gate relative to the trailing gate. In other words, the gates in their extended position are essentially end to end with some overlap.

The rear end of the trailing gate remains partly in the pocket beside the driveway since, for outdoor gates, there is no practical way to provide an overhead guide along the full length of travel of the gates, and the trailing gate is kept vertical by guides which are beside the driveway and engage a short length of the gate at all positions between and including the retracted and extending positions. The leading gate 11 moves far beyond its retracted position and typically extends to a post or the like at the opposite side of the driveway. A portion of the rear of the leading gate overlaps a portion of the front of the trailing gate. This is done so that guide brackets can be provided between the tops of the leading and trailing gates for supporting the leading gate in its vertical position.

Figure 3:
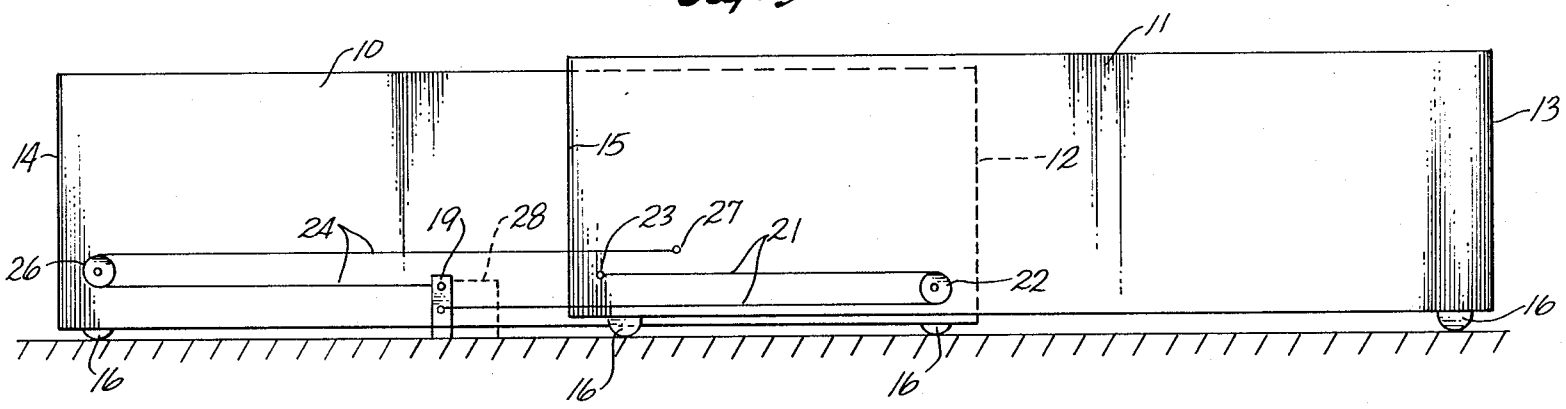
FIG. 3 is a side schematic view of a pair of gates, slightly for ease of illustration.
Figure 4:
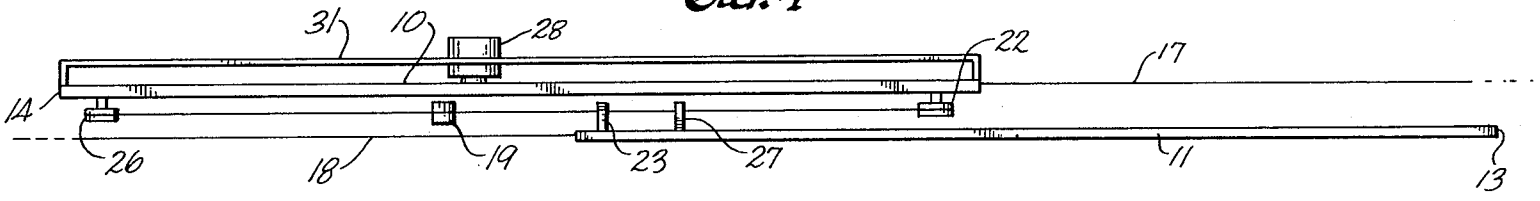
FIG. 4 is a top schematic view of the pair of gates of FIG. 3.
Figure 5:
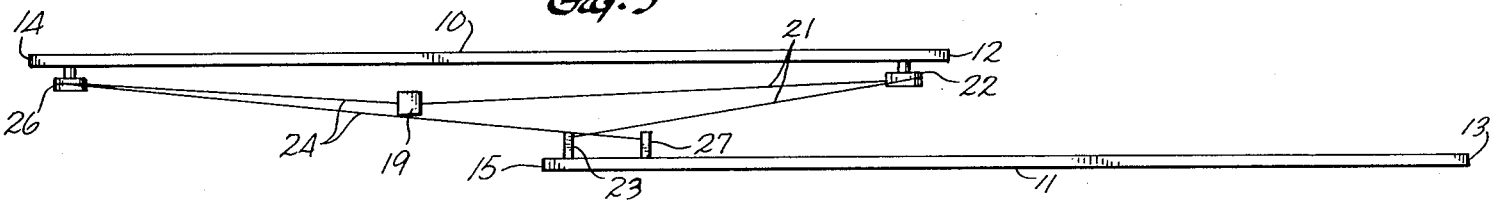
FIG. 5 a top schematic view like that of FIG. 4 with the gates displaced for ease of illustrating the extension mechanism.

FIGS. 3 to 5 illustrate a pair of stacking gates in an arbitrary intermediate position. For clarity in the drawing, the leading gate 11 is drawn as if somewhat higher than the trailing gate 10. This would not ordinarily be the case in an embodiment as built, and the two gates would be of the same size. The gates each include wheels 16 which roll along parallel tracks 17 and 18 for the trailing and the leading gates, respectively. Typically, the tracks are triangular, and wheels with a V-shaped rim ride on the apex of the track. Other track styles may also be used.

An anchor post (or wall) 19 is between the tracks near the front of the gates when they are in their retracted position. An extension roller chain 21 has one end attached securely to the anchor post. The extension chain wraps around a front idler sprocket 22 mounted near the front of the trailing gate. The other end of the extension chain is secured to a rear stud 23 near the rear of the leading gate.

A retraction roller chain 24 has one end secured to the anchor post 19. The retraction chain wraps around a rear idler sprocket 26 mounted on the trailing gate near its rear end 14. The other end of the retraction chain is connected to a front stud 27 on the leading gate. The front stud can be anyplace on the leading gate so long as it is beyond the rear idler when the gates are retracted.

It will be noted that there is, in effect, a single chain connected to the leading gate at its opposite ends, wrapping around two idlers at the opposite ends of the trailing gate, and being anchored between the idlers.

These structures are illustrated in FIG. 3 as if the gates were transparent. Thus, it will be recognized that portions of the roller chains, the studs, and the front idler pulley 22 are illustrated in solid line, even though they could have been illustrated in dash line because hidden by the leading gate. In the top view of FIG. 4, the roller chains are all in the same plane, and their relationship is not easily apparent. Thus, to aid in exposition, the two gates are displaced from each other in FIG. 5, so that the roller chains do not all appear to be in the same plane and their paths can be seen. Some of the structure has been omitted in FIG. 5.

A motor drive 28 is provided for moving the trailing gate between its extended and retracted positions. The motor drive may be connected to the trailing gate by any conventional means, such as a screw, roller chain, or the like. Since this is all conventional, it is indicated only schematically in FIGS. 3 and 4. The gates may also be moved manually, either by pulling or pushing on either the leading gate or the trailing gate. The roller chains serve to coordinate movement of the gates relative to each other regardless of how they are driven.

When the trailing gate is moved from its retracted position toward its extended position, this necessarily causes the idler sprockets to also move with the gate. Since the front idler sprocket 22 moves away from the post, the reach of the roller chain between the front idler sprocket and post must increase in length. At the same time, the reach of chain between the front idler sprocket 22 and the stud 23 near the rear of the leading gate must shorten. This necessarily moves the rear stud and hence the leading gate forwardly from its retracted position toward its extended position at a rate twice as fast (and a distance twice as far) as movement of the trailing gate. During such advance of the gates, the retraction chain has no tension on it as the reach of the chain between the front stud 27 and the rear idler 26 increases in length and the reach between the rear idler sprocket and the post decreases in length.

When the trailing gate is driven towards its retracted position, the idler sprockets on the trailing gate also move with the gate. Thus, the reach of the retraction chain between the post and rear idler sprocket 26 increases in length and the reach of chain between the sprocket and the front stud 27 necessarily decreases in length. This causes a pulling on the front stud and retracts the leading gate at a rate twice as fast (and twice as far) as the trailing gate.

It will be noted that the idler sprockets do not drive the gates in the manner of a gear or the like. They simply serve as pulleys, and movement of the leading door is due to changes in the lengths of reaches of the chain.

Figure 6:
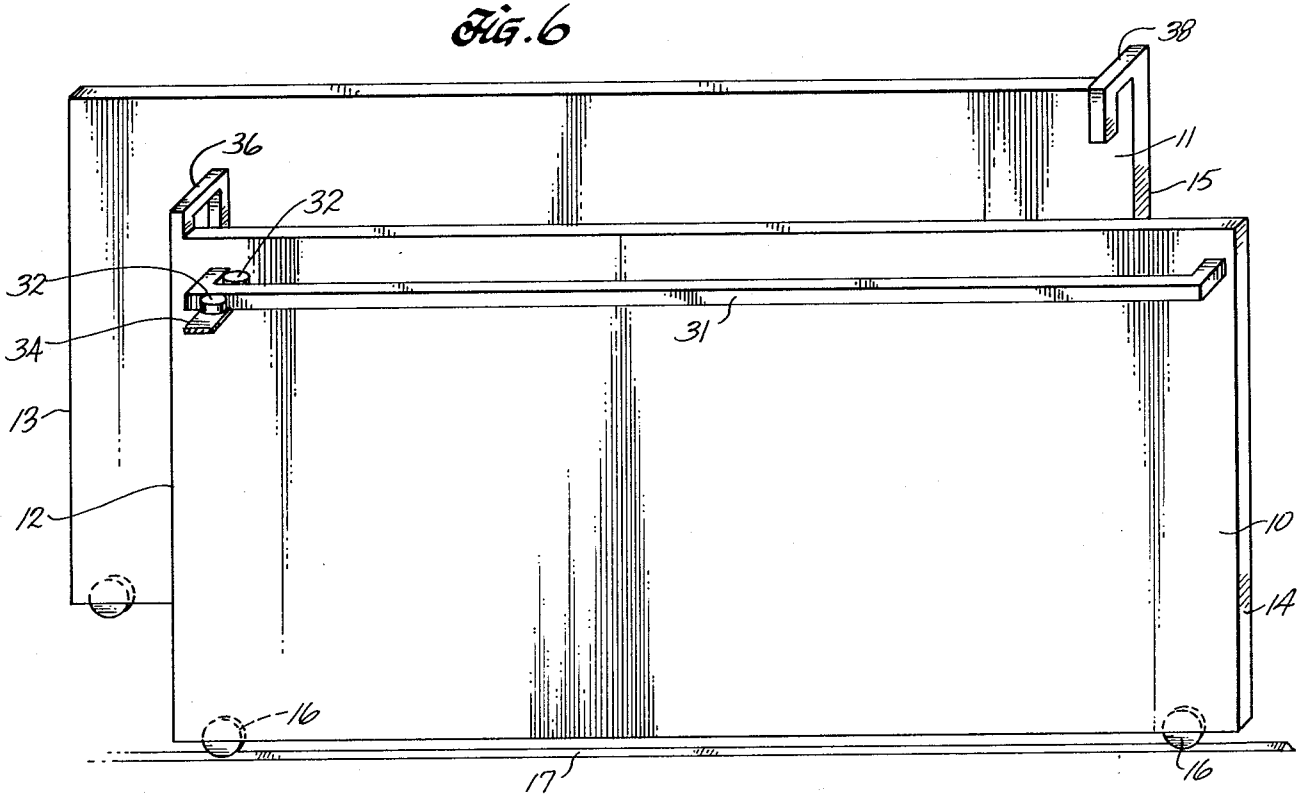
FIG. 6 a perspective view of a pair of gates displaced from each other for disclosing additional structure.

FIGS. 6 and 7 are perspective views illustrating means for keeping the gates erect. In the schematic view of FIG. 6, the gates are displaced from each other so that the leading gate 11 appears raised and set back relative to the trailing gate 10. FIG. 7 shows the front ends of the gates when in their retracted position. The view is looking at the ends of the gates in a somewhat upward direction.

Where gates are used in the open, special means must be provided for keeping the gates erect in both the retracted and extended positions and all positions in between. The trailing gate is kept erect by a horizontal guide bar 31 extending along the length of the trailing gate near its top edge. The guide bar is captive between rollers 32 which are mounted on a stout post 33 by upper and lower plates 34. The post sits beside the driveway. The support rollers on the guide bar and the engagement of the wheels with the track keep the trailing gate erect throughout its travel. The mounting plates 34 keep the guide bar captive and provide a measure of safety in the event the gate is derailed. For a long gate, a second set of rollers (not shown) may be provided for engaging the guide bar three or four feet apart for added stiffness.

The leading gate is kept erect by the trailing gate. For this purpose, a U-shaped bracket 36 extends from the top of the trailing gate 10 at its front end over the top of the leading gate 11 and down its opposite side (FIG. 7). Stabilizing rollers 37 mounted on the bracket or edge of the trailing gate engage opposite faces of the leading gate near its upper edge. A similar U-shaped bracket 38 on the rear of the leading gate extends over the top of the trailing gate. Similar rollers (not separately illustrated) on the second U-shaped bracket engage opposite faces of the trailing gate along its top edge.

When the two gates are in their retracted positions, these brackets are far apart and firmly support the top of the leading gate. When the gates are in their extended position, they overlap enough that the brackets are four feet or so apart, and the top of the leading gate is firmly supported by the trailing gate. Thus, the tops of the gates are held a uniform distance apart at all times.

Figure 8:
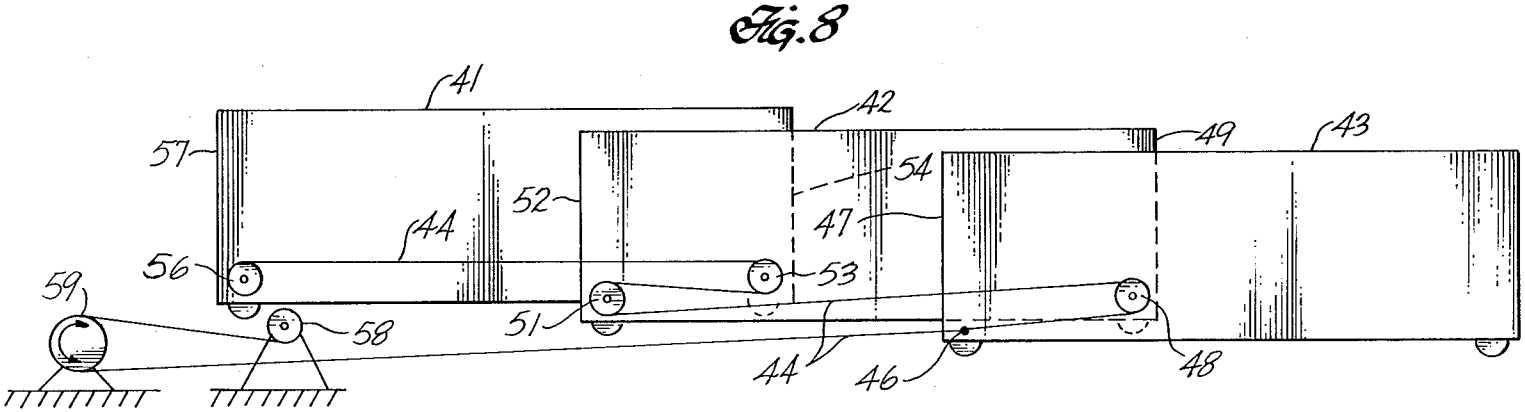
FIG. 8 is a side schematic view of another embodiment with three gates displaced from each other for ease of illustration of the operating mechanism.

FIG. 8 illustrates a set of stacking gates or doors wherein three gates can be moved between extended and retracted positions with a single roller chain. The three gates are illustrated with a trailing gate 41 drawn as if it were elevated relative to an intermediate gate 42, which is in turn drawn as if it were elevated with respect to a leading gate 43. It will be appreciated that, in actuality, the three gates roll on parallel tracks which are all at the same elevation. This sort of exploded schematic view is employed in the drawings so that the roller chain and its sprockets can be drawn enlarged to clearly show the path of the chain.

A roller chain 44 between the trailing and intermediate gates has its ends connected to a stud 46 near the rear end 47 of the leading gate 43. The chain then wraps around an idler sprocket 48 near the front end 49 of the intermediate gate 42. At each sprocket the chain essentially reverses direction, wrapping about 180 around the sprocket. From there, the chain wraps around an idler sprocket 51 near the rear 52 of the intermediate gate. The chain then returns toward the front of the assembly of gates and wraps around an idler sprocket 53 near the front 54 of the trailing gate 41. The chain again reverses direction and passes around an idler sprocket 56 near the rear 57 of the trailing gate. The roller chain then wraps around an idler sprocket 58 which is anchored to the ground. This again reverses the direction of the chain, and it passes around a drive sprocket 59 which is also anchored to the ground. After passing around the drive sprocket, the chain returns to the rear of the leading gate where its second end is connected to the stud 46. A conventional chain tightener (not shown) is typically used at one end of the chain to take up slack.

Thus, the chain is essentially a continuous chain wrapping back and forth over the various idlers and drive sprockets with a mid-portion anchored to the leading gate.

Since the chain is in the plane between the trailing and intermediate gates, the stud 46 on the leading gate extends underneath the middle of the intermediate gate for making its connection to the chain. Alternatively, it may extend through a slot along the length of the intermediate gate. Either way, the stud extends past the plane of the intermediate gate for interconnecting the chain and leading gate.

The drive sprocket can be motor-driven to rotate in either direction. If it rotates in the clockwise direction as illustrated in FIG. 8, the reach of chain between the drive sprocket and the stud 46 gets shorter. This draws the leading gate toward its retracted position. At the same time, the reach of chain between the stud and first idler sprocket 48 at the front of the intermediate gate increases in length. This moves the intermediate gate toward its retracted position. When the leading and intermediate gates are retracted so that they are side by side, the reach of chain between the idler sprocket 51 at the rear of the intermediate gate and the idler sprocket 53 at the front of the trailing gate begins to lengthen, and the trailing gate is thereby moved toward its retracted position. As it moves, there is a concomitant increase in length of the reach of chain between the idler sprocket 56 at the rear of the trailing gate and the fixed position sprocket 58. This motion continues until the three gates are completely retracted.

To extend the three gates, the drive sprocket 59 is driven in its opposite direction. This shortens the reach of chain between the rear idler sprocket 56 on the trailing gate and the fixed position idler sprocket 58, thereby pulling the trailing gate toward its extended position. Following this, shortening of the reaches of chain between the idler sprockets 51 and 53 and between the idler sprocket 48 and the stud 46 act to project the intermediate and leading gates toward their extended position.

Guide bars (not shown) similar to the guide bar 31 and guide rollers may be used between the gates for keeping the three gates erect.

Although limited embodiments of stacking gates with means for extending and retracting the gates have been described and illustrated herein, many modifications and variations will be apparent to those skilled in the art. Thus, instead of being gates for a driveway, or doors for a hangar, such structures might be used for elevator doors, for example. In such an embodiment, guides may be provided at the top of the doors because of the presence of overhead structure, and the brackets may be deleted. On the other hand, brackets as described herein may be employed for supporting outdoor stacking gates with other mechanisms for extending and retracting the gates.

Although it is far preferred that a roller chain be used for extending and retracting the doors, it will be recognized that other flexible extension and retraction members could be used. For example, there are other types of usable chains. Further, one could use a cable where the repeated flexing is tolerable. It is, therefore, to be understood that, within the scope of the appended claims, the invention may be practiced otherwise than as specifically described.

What is claimed is:

1. A pair of stacking gates or doors comprising:

a trailing gate including wheels for rolling along a first track between a retracted position and an extended position;

a leading gate including wheels for rolling along a second track parallel to the first track between a retracted position approximately side-by-side with the trailing gate and an extended position further from the retracted position than the trailing gate;

a fixed anchor between the tracks;

a rear idler on the rear of the trailing gate;

a flexible retraction member having one end connected to the fixed anchor, wrapped around the rear idler, and connected at the other end to the leading gate;

a front idler on the front of the trailing gate;

a flexible extension member having one end connected to the fixed anchor, wrapped around the front idler, and connected at the other end to the rear of the leading gate; and means at the top of the gates for maintaining the tops of the gates spaced apart a uniform distance from each other.

2. A pair of stacking gates or doors as recited in claim 1 wherein the idlers each comprise a sprocket and the retraction member and extension member each comprise a roller chain passing around one of such sprockets.

3. A pair of stacking gates or doors as recited in claim 1 further comprising means for driving the trailing gate between the retracted and extended positions.

4. A pair of stacking gates or doors as recited in claim 1 wherein the means for maintaining the tops of the gates spaced apart a uniform distance from each other comprises a pair of generally U-shaped brackets, each of the brackets having one end connected to the top of one of the gates and the other end extending over the top of the other gate and including rollers on both sides of the other gate for guiding engagement with the other gate, one of the brackets being connected to the trailing gate at its front end, and the other bracket being connected to the leading gate at its rear end.

5. A pair of stacking gates or doors as recited in claim 1 wherein the means for maintaining th tops of the gates spaced apart a uniform distance from each other comprises:

a rear bracket mounted at the top of the trailing gate at its leading end and having a portion extending over the top of the leading gate, and rollers in the rear bracket on opposite faces of the leading gate for guiding the top of the leading gate; and a front bracket mounted at the top of the leading gate at its rear end and having a portion extending over the top of the trailing gate, and rollers in the front bracket on opposite faces of the trailing gate for guiding the top of the trailing gate.

6. A pair of stacking gates or doors comprising:

a trailing gate including wheels for rolling along a first track between a rear retracted position and a front extended position;

a leading gate including wheels for rolling along a second track parallel to the first track between a rear retracted position side-by-side with the trailing gate and a front extended position further from the retracted position than the trailing gate;

a rear idler on the rear of the trailing gate;

a front idler on the front of the trailing gate;

a flexible member between the gates having one end connected to the leading gate, wrapping around the rear idler, wrapping around the front idler, and connected at the other end to the rear of the leading gate;

means for anchoring a mid-portion of the flexible member between the front and rear idlers; and means at the top of the gates for maintaining the tops of the gates spaced apart a uniform distance from each other 7. A pair of stacking gates or doors as recited in claim 6 wherein the idlers each comprise a sprocket and the flexible member comprises a roller chain.

8. A pair of stacking gates or doors as recited in claim 6 further comprising means for driving the trailing gate between the retracted and extended positions.

9. A pair of stacking gates or doors as recited in claim 6 wherein the means for maintaining the tops of the gates spaced apart a uniform distance from each other comprises a pair of generally U-shaped brackets, each of the brackets having on end connected to the top of one of the gates and the other end extending over the top of the other gate and including rollers on both sides of the other gate for guiding engagement with the other gate, one of the brackets being connected to the trailing gate at its front end, and the other bracket being connected to the leading gate at its rear end.

10. A pair of stacking gates or doors as recited in claim 6 wherein the means for maintaining the tops of the gates spaced apart a uniform distance from each other comprises:

a rear bracket mounted at the top of the trailing gate at its leading end and having a portion extending over the top of the leading gate, and having means for guiding both sides of the top of the leading gate; and a front bracket mounted at the top of the leading gate at its rear end and having a portion extending over the top of the trailing gate, and having means for guiding both sides of the top of the trailing gate.

11. A set of stacking gates or doors comprising:

a trailing gate including wheels for rolling along a first track between a rear retracted position and a front extended position;

a leading gate including wheels for rolling along a second track parallel to the first track between a rear retracted position and a front extended position;

an intermediate gate between the leading and trailing gates, and including wheels for rolling along an intermediate track between a rear retracted position and a front extended position, the gates in their retracted position being essentially side-by-side and in their extended position being essentially end to end with some overlap;

a roller chain between the trailing and intermediate gates connected at one end to the rear of the leading gate, wrapping around an idler sprocket on the front of the intermediate gate, wrapping around an idler sprocket on the rear of the intermediate gate, wrapping around an idler sprocket on the front of the trailing gate, wrapping around an idler sprocket on the rear of the trailing gate, wrapping around an idler sprocket on a fixed anchor between the gates, wrapping around a drive sprocket at a fixed point, and having its other end connected to the rear of the leading gate; and means for extending the locus of connection of the chain to the leading gate past the intermediate gate to be between the trailing and intermediate gates so that the roller chain is substantially in a single plane.

12. A set of stacking gates or doors as recited in claim 11 wherein the means for extending comprises a bracket extending from the leading gate past the plane of the intermediate gate for connection to the roller chain.

13. A set of stacking gates or doors comprising:

a trailing gate including wheels for rolling along a first track between a rear retracted position and a front extended position;

a leading gate including wheels for rolling along a second track parallel to the first track between a rear retracted position and a front extended position;

an intermediate gate between the leading and trailing gates, and including wheels for rolling along an intermediate track parallel to the first track between a rear retracted position and a front extended position; and an essentially continuous flexible member connected at one end to the rear of the leading gate, wrapping around an idler on the front of the intermediate gate, wrapping around an idler on the rear of the intermediate gate, wrapping around an idler on the front of the trailing gate, wrapping around an idler on the rear of the trailing gate, wrapping around an idler on a fixed anchor between the gates, wrapping around a drive pulley at a fixed point, and having its other end connected to the rear of the leading gate.

14. A set of stacking gates or doors as recited in claim 13 wherein the flexible member comprises a roller chain and the idlers each comprise sprockets for the roller chain.

15. A set of stacking gates or doors as recited in claim 14 wherein the chain is in a plane between the trailing intermediate gates, and a stud on the leading door extending past the plane of the intermediate gate for connection to the chain.

* * * * *